US005144744A

United States Patent [19]

Campagnoli

[11] Patent Number: 5,144,744

[45] Date of Patent: Sep. 8, 1992

[54] MANUFACTURING METHOD OF A DIAMOND-MESH POLYETHYLENE NETTING SPONGE

[76] Inventor: Antonio Campagnoli, Via Sidoli 39, Piacenza, Italy

[21] Appl. No.: 785,875

[22] Filed: Nov. 1, 1991

Related U.S. Application Data

[62] Division of Ser. No. 413,277, Sep. 27, 1989, abandoned.

[30] Foreign Application Priority Data

Apr. 3, 1989 [IT] Italy ..... 44804 A/89

[51] Int. Cl.[5] ..... B23P 11/02

[52] U.S. Cl. ..... 29/446; 29/452; 29/235; 100/2; 100/8

[58] Field of Search ..... 29/446, 450, 452, 235; 428/4, 135, 137, 36.1, 172, 223, 516, 913; 15/244.4, 244.1, 209 R, 208, 225, 226; 100/2, 8

[56] References Cited

U.S. PATENT DOCUMENTS

| | | | |
|---|---|---|---|
| 2,581,779 | 1/1952 | Abraham | 15/209 B |
| 3,281,884 | 11/1966 | Feil | 15/226 |
| 3,336,618 | 8/1967 | Day | 15/209 B |
| 3,345,668 | 10/1967 | Forrest | 15/209 C |
| 4,199,835 | 4/1980 | Heyer et al. | 15/209 B |
| 4,462,135 | 7/1984 | Sanford | 15/209 C |

*Primary Examiner*—Timothy V. Eley
*Attorney, Agent, or Firm*—Notaro & Michalos

[57] ABSTRACT

A diamond-mesh polyethylene sponge is obtained from a number of netting tubes stretched over supports, joined and bound together at the center and then released from the supports.

6 Claims, 2 Drawing Sheets

FIG 3
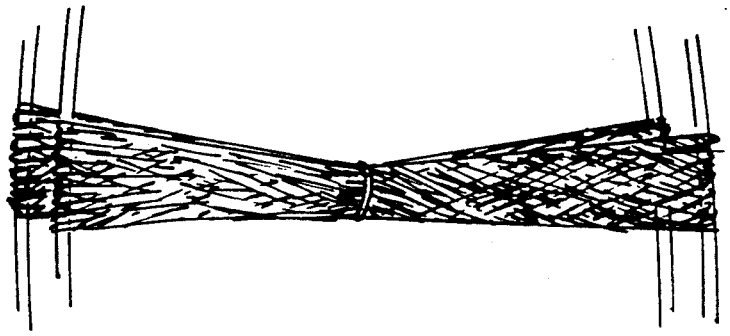
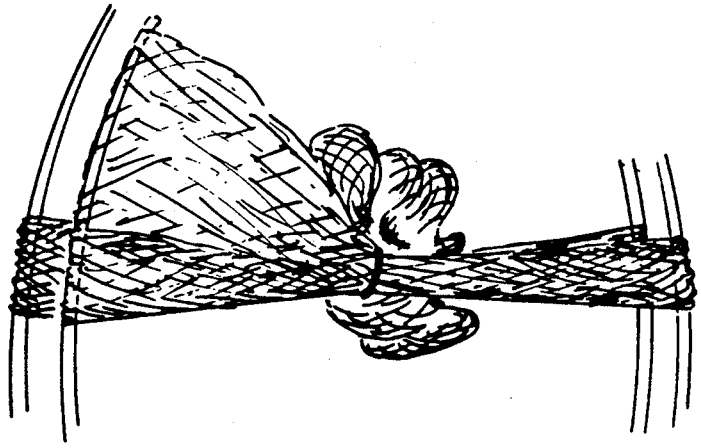
FIG 4

MANUFACTURING METHOD OF A DIAMOND-MESH POLYETHYLENE NETTING SPONGE

This application is a division, of application Ser. No. 413,277, filed Sep. 27, 1989, now abandoned.

FIELD AND BACKGROUND OF THE INVENTION

This invention relates to a polyethylene netting sponge. In particular, the sponge is made of diamond-mesh extruded polyethylene netting of the sort used to make fruit and vegetable bags.

The invention also relates to the method of manufacturing the said sponge.

Synthetic sponges are known which are made from a variety of materials, but all with semi-open cells, ie. sponges whose cells present a continuous wall.

These known sponges, whose absorption power depends on the cell size, present a number of drawbacks because, due to the cell structure they are difficult to clean thoroughly.

They need to be rinsed many times, and traces of deposits still remain on the cell walls. Known sponges are therefore difficult to dry and are unhygienic.

SUMMARY OF THE INVENTION

This invention proposes a sponge, specifically a bath sponge, which eliminates these drawbacks.

The sponge is made of diamond-mesh polyethylene netting; due to the characteristics of the material from which it is made it remains perfectly elastic, is very easy to clean and dries rapidly.

This netting is already known, but is used in other fields for totally different purposes from that covered by this invention. The sponge in accordance with the invention is made from netting tubes which are stretched over supports and bound together at the center.

BRIEF DESCRIPTION OF THE DRAWINGS

This invention will be described in detail, by way of example but not of limitation, by reference to the annexed figures in which:

FIG. 2 to 4 illustrates the various stages of manufacture of the sponge.

DESCRIPTION OF THE PREFERRED EMBODIMENT

The sponge in accordance with the invention is made from a number of diamond-mesh polyethylene netting tubes which are stretched over a pair of supports designed to keep them taut.

Figure 2:
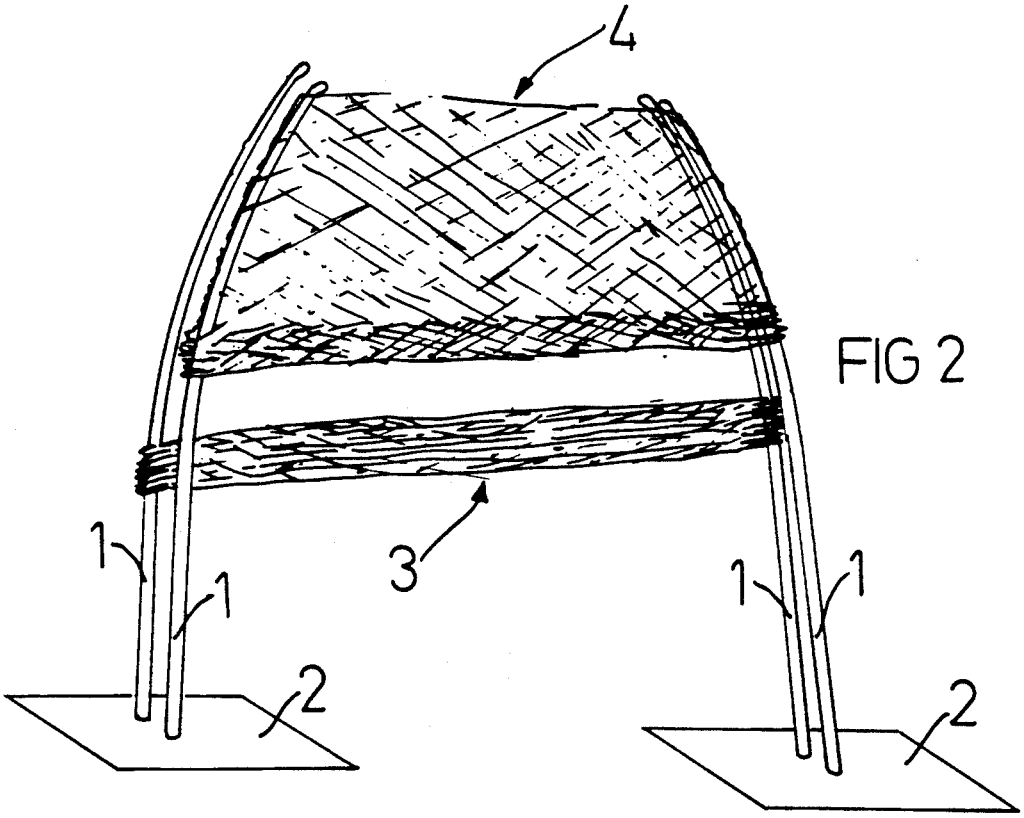

FIG. 2 shows these supports 1 secured to a pair of bases 2. The supports curve inwards at the top so that they come close together and the tubes can be stretched over them more easily.

FIG. 2 shows a netting tube 4 totally stretched over the supports Two or more tubes are stretched over the supports, then bound together at the center with a plastic strip or other known system.

This stage is shown in FIG. 3.

Figure 1:
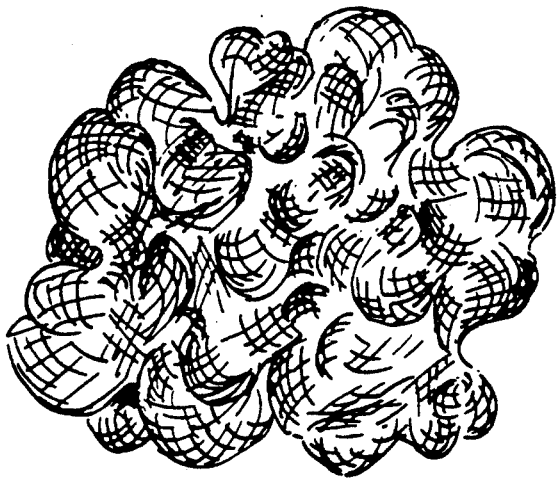
FIG. 1 illustrates a sponge in accordance with the invention

When the tubes have been tied together, the ends are removed from supports 1 (FIG. 4) to obtain the sponge as shown in FIG. 1.

As shown in FIGS. 2 and 3, each of the tubes of polyethylene netting are pre-stretched in a direction which is transverse to the axis of the tubes (the axis of the tubes would be vertical in FIGS. 2 and 3) until they are in the condition of FIG. 3 and thereafter all of the tubes are connected to each other by a plastic strip which is wrapped around all of the tubes near the axis of the tubes.

The elasticity of polyethylene means that the sponge always maintains its original volume.

Due to the characteristics of the netting from which the sponge is made, it is very easy to clean. Short rinsing is sufficient to eliminate all trace of dirt, and the sponge then dries rapidly.

An expert in the field could devise numerous modifications and variations, all of which should be deemed to fall within the ambit of this invention.

I claim:

1. A method of manufacturing a bath sponge, comprising:

stretching a plurality of tubes made of diamond-mesh resilient synthetic netting, in a direction transverse to a longitudinal axis of the tubes;

binding all of the stretched tubes together near a common center of all of the stretched tubes; and releasing all of the tubes from their stretched condition, whereby the tubes through their resiliency rebound into a rounded sponge shape around the binding of the tubes.

2. A method according to claim 1 including stretching each tube between a pair of supports, each tube being gathered on its respective pair of supports before all of the tubes are bound to each other.

3. A method according to claim 2 including binding all of the tubes to each other using a plastic strip.

4. A method according to claim 3 wherein each tube of netting is made of diamond-mesh polyethylene.

5. A method according to claim 4 wherein each pair of supports comprises a pair of elongated supports each having one end connected at a fixed location and an opposite free end, whereby the opposite free ends of each pair of supports can be bent toward each other for receiving a tube of netting, the tube of netting being gathered toward the fixed ends of each support pair, for stretching each tube of netting between each pair of supports.

6. A method according to claim 1 wherein each pair of supports comprises a pair of elongated pole supports each having one end connected at a fixed location and an opposite free end, whereby the opposite free ends of each pair of supports can be bent toward each other for receiving a tube of netting, the tube of netting being gathered toward the fixed ends of each support pair, for stretching each tube of netting between each pair of supports.

* * * * *